US005542567A

United States Patent [19]

Julius

[11] Patent Number: 5,542,567

[45] Date of Patent: Aug. 6, 1996

[54] MOIST TISSUE PACKAGE CONSTRUCTION AND TISSUE

[75] Inventor: Robert P. Julius, Greenwich, Conn.

[73] Assignee: Nice-Pak Products, Inc., Orangeburg, N.Y.

[21] Appl. No.: 298,603

[22] Filed: Aug. 31, 1994

[51] Int. Cl.[6] ..... B65H 1/00

[52] U.S. Cl. ..... 221/63; 221/46

[58] Field of Search ..... 221/63, 33, 34, 221/45, 46, 312 C; 206/409, 812, 449

[56] References Cited

U.S. PATENT DOCUMENTS

| | | | |
|---|---|---|---|
| 3,784,056 | 1/1974 | Spruyt et al. | 221/63 |
| 3,819,043 | 6/1974 | Harrison | 206/449 |
| 3,836,045 | 9/1974 | Duhy et al. | 221/63 |
| 4,156,493 | 5/1979 | Julius | 221/63 |
| 4,185,754 | 1/1980 | Julius | 221/63 |
| 4,289,262 | 9/1981 | Finkelstein | 225/106 |
| 4,411,374 | 10/1983 | Hotchkiss | 221/63 |
| 4,462,507 | 7/1984 | Margulies | 221/63 |
| 4,469,243 | 9/1984 | Ito et al. | 221/34 |
| 4,535,912 | 8/1985 | Bonk | 221/46 |
| 4,574,952 | 3/1986 | Masui | 206/494 |
| 4,836,410 | 6/1989 | Mastrobuoni | 221/63 |
| 4,863,064 | 9/1989 | Dailey, III | 221/48 |
| 4,899,905 | 2/1990 | Holtsch | 221/63 |
| 5,024,349 | 6/1991 | Haenni et al. | 221/46 |
| 5,135,134 | 8/1992 | Dancy | 221/61 |
| 5,158,180 | 10/1992 | Zucker | 206/409 |
| 5,219,421 | 6/1993 | Tipping | 221/63 |
| 5,316,177 | 5/1994 | Boldt | 221/63 |

*Primary Examiner*—Kenneth Noland
*Attorney, Agent, or Firm*—Banner & Allegretti, Ltd.

[57] ABSTRACT

The combination of zig zag folded tissue stack has separate portions of the tissue defined by lateral perforations. The tissue is a moisturized tissue and is retained in a special rectangular container with the free end of the tissue fitted through a slit which frictionally retains the tissue unless it is manually moved through the slit. The slit is fashioned in a manner which facilitates tearing of the portions of the tissue along the perforations after it is withdrawn through the slit. A cap for the slit is designed to keep the exposed portion of the tissue moist.

50 Claims, 5 Drawing Sheets

Fig. 5
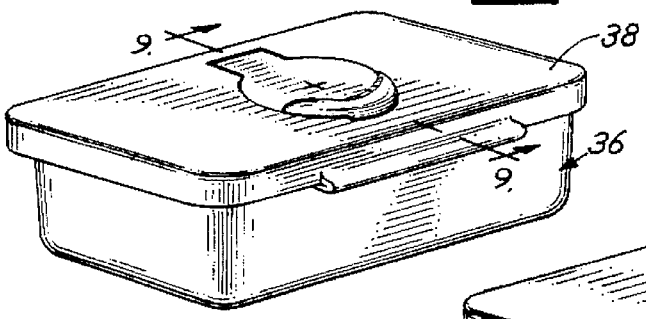
Fig. 6
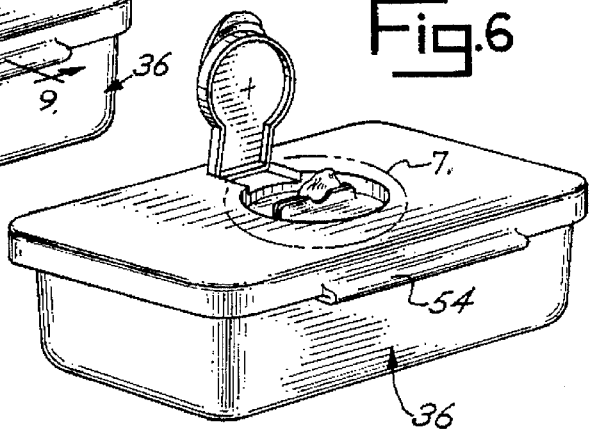
Fig. 8
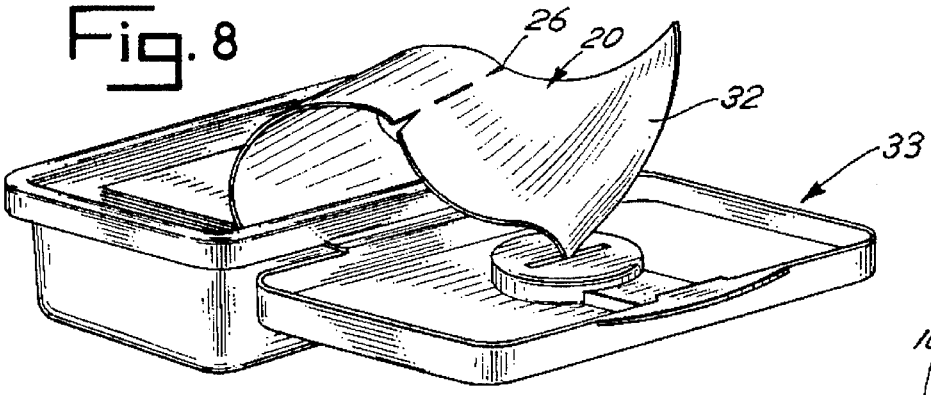
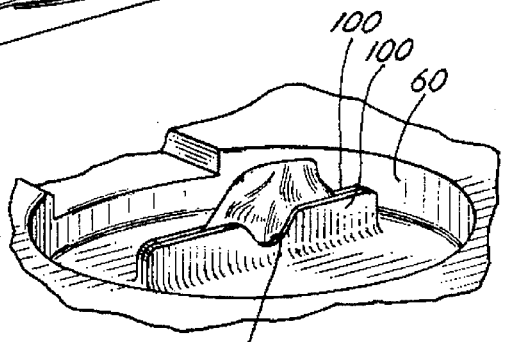
Fig. 7
Fig. 9
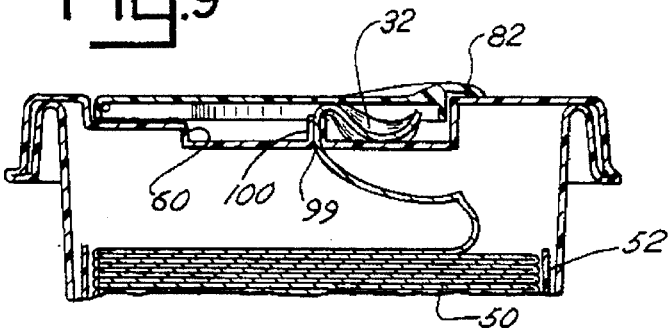

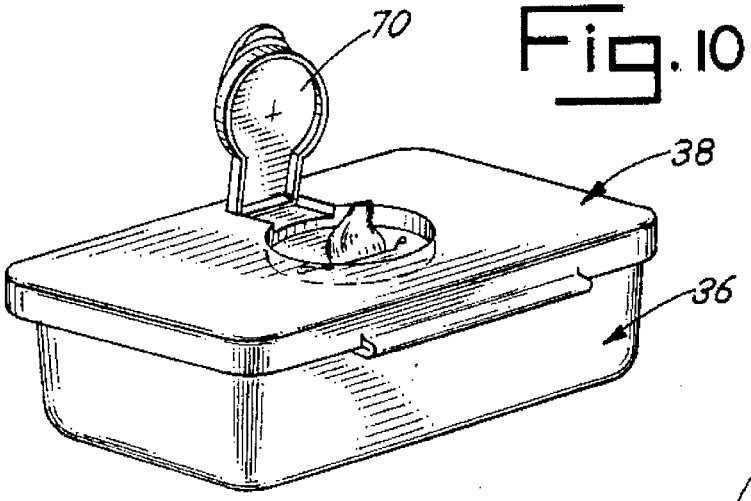
Fig. 10
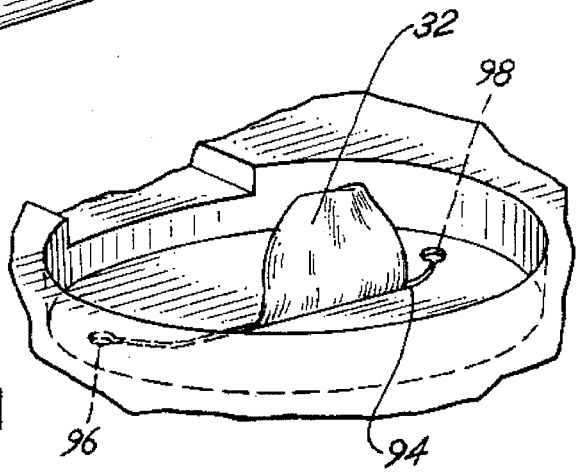
Fig. 11
Fig. 12
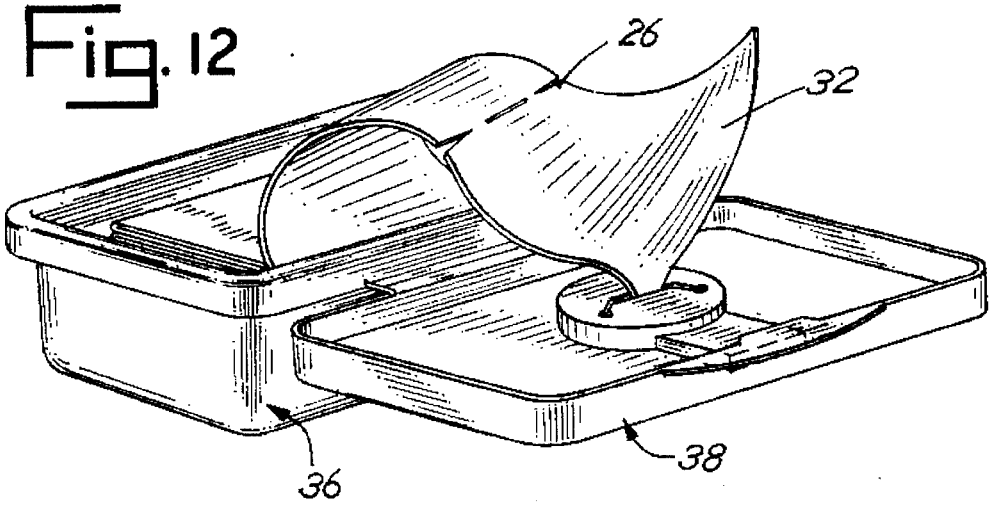

MOIST TISSUE PACKAGE CONSTRUCTION AND TISSUE

BACKGROUND OF THE INVENTION

This invention relates to a package for moist tissues or towelettes and, more particularly, to a dispensing container for moist tissues formed as a stack from a continuous elongated sheet of connected tissue sections separated by tear perforations and folded in a zig zag pattern.

The dispensing of moisturized tissues, cloths or towelettes from a container has been the subject matter in various prior art patents. For example, Margulies in U.S. Pat. No. 4,462,507 discloses a cylindrical container which is designed to hold a roll of pre-moistened towels. The towels are apparently removed from the container by directing the free end from the center of the cylindrical roll tough an opening in the top of the cylindrical container or canister. Bonk in U.S. Pat. No. 4,535,912 discloses a dispenser wherein the outside end of a roll of moistened towels is dispensed from a rectangular dispenser. The towels on the roll are dispensed from the outside of the roll as the roll unwinds through a slot in the top of the dispenser. Holtsch in U.S. Pat. No. 4,899,905 discloses a square container wherein a folded stack of pre-moistened towels are dispensed through an opening in the top lid of the container. The pre-moistened, square shape towels are connected together at their corners.

Duhy and Jones in U.S. Pat. No. 3,836,045 disclose a rectangular container used to dispense liquid saturated, separate, folded disposable towels through a shaped center dispensing slot in the container. Dailey in U.S. Pat. No. 4,863,064 discloses a flexible dispenser packet for dispensing pre-moistened towelettes interfolded and removeable one at a time through an opening configured in the top of the flexible package. Similar dispensing packets are disclosed in Julius, U.S. Pat. No. 4,156,493 and U.S. Pat. No. 4,185,754. Harrison in U.S. Pat. No. 3,819,043 discloses yet another package for pre-moistened towelettes wherein the towelettes are interfolded. Similarly, Spruyt, et al. in U.S. Pat. No. 3,784,056 discloses a moisture impermeable package which includes a flexible container and a discharge slit in the top surface for removal of moist towelettes from the container.

The identified prior art patents disclose useful packages for the purpose of discharging or dispensing pre-moistened towelettes from either a continuous roll or alternatively as separate, interfolded, pre-moistened, rectangular towelettes. Nonetheless, there has remained the need for an improved dispensing system for moist towelettes, especially towelettes from a continuous, elongated sheet which does not require expensive cutting and interfolding machinery.

SUMMARY OF THE INVENTION

Briefly, the present invention comprises the combination of a moist tissue sheet and an associated dispenser for that sheet wherein the sheet is an elongated tissue sheet having a free outer end and is comprised of a series of generally equally sized sections separated by perforations in the sheet between each section. The sheet is folded in a zig zag, overlay pattern to provide a stack of connected, folded towelettes. The tissue dispensing container includes a separable lid or top that is sealed sufficiently with a container box to prevent escape of moisture from the stack or folded tissue sheet. The container and top are rectangular and have a shape and size generally congruent with the stack of folded tissue so that the full stack may be retained therein. The top further includes a slit for receipt of the free end of the stack of towelettes. The slit is positioned generally midway between the sides of the top in a counterbore recess defined in the top. The slit extends only partially across the width of the side to side dimension of the top. The slit is defined by slit sides which are spaced apart from one another a distance which is greater than the thickness of the tissue whereby the tissue may be pulled through the slit while being frictionally restrained by the slit sides to permit tearing of the sheet along the line of spaced perforations as the sheet is prevented from freely sliding in the slit in either direction. Various additional features are included such as an integral cap which seals in the counterbore recess in the top, certain preferred slit sizes and shapes, and special integral friction engaging members or lips associated with the slit.

Thus, it is an object of the invention to provide an improved moist tissue dispenser.

It is a further object of the invention to provide a moist tissue dispenser which dispenses an elongated folded sheet of moist tissue wherein the sheet is divided into separate folded sections, each section being separated from the other by a line of tear perforations.

Another object of the invention is to provide a moist tissue dispenser having a unique construction for the top or lid of the dispenser and, more particularly, a unique construction for the discharge slit through which the moist tissue is dispensed.

Yet a further object of the invention is to provide a moist tissue dispenser sufficiently sealed to prevent the escape of moisture and thus designed to maintain the folded tissue moist therein.

Another object of the invention is to provide a moist tissue dispenser which is adapted to have a removable top for receipt of a stack of folded moist tissue in the container for dispensing therefrom.

Another object of the invention is to provide a moist tissue dispenser having a unique tissue dispensing slit construction whereby the tissue is appropriately frictionally restrained by the slit sufficiently to permit tearing of the sheet along a line of spaced perforations as the sheet is prevented from freely sliding in the slit in either direction.

Another object of the invention is to provide a moist tissue dispenser which is reusable and refillable.

A further object of the invention is to provide a moist tissue dispenser capable of dispensing connected, single tissues one at a time through a dispenser slit from an elongated sheet of connected tissues wherein such dispensing may be effected manually with one hand.

Another object of the invention is to provide a moist tissue dispenser which may be used to dispense single tissues from a folded, elongated sheet and which does not require separate interfolded tissues and thus does not require use of expensive separate, single tissue interfolding equipment.

Yet another object of the invention is to provide a tissue dispensing package which permits the usage of inexpensive, zig zag folding equipment for the tissue sheet contained in the tissue dispenser.

Another object of the invention is to provide a tissue dispensing package which facilitates one handed, manual removal of the free end of a sheet of tissues through a slit in the top or lid of the dispenser and tearing of the tissue from the sheet along a line of perforations while the free end of the sheet remains in the slit.

Another object of the invention is to provide a tissue dispenser wherein the tissue is not twisted during removal from the dispenser, but is removed from a folded, zig zag stack.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 5 is an isometric view of a second embodiment of the invention;

FIG. 6 is an isometric view of the embodiment of FIG. 5 wherein the free end of a tissue stack has been pulled through a slit in the lid of the dispenser;

FIG. 7 is an enlarged isometric view of the slit construction depicted in FIG. 6;

FIG. 8 is an isometric view of the embodiment of FIG. 5 with the dispenser lid opened;

FIG. 9 is a sectional view of the embodiment of FIG. 5 taken along the line 9—9 in FIG. 5;

FIG. 10 is a perspective view of another embodiment of the invention;

FIG. 11 is an enlarged isometric view of the slit construction of the embodiment of FIG. 10;

FIG. 12 is an isometric view of the embodiment of FIG. 10 with the dispenser lid opened;

DESCRIPTION OF THE PREFERRED EMBODIMENT

The Elongated Folded Tissue

Figure 17:
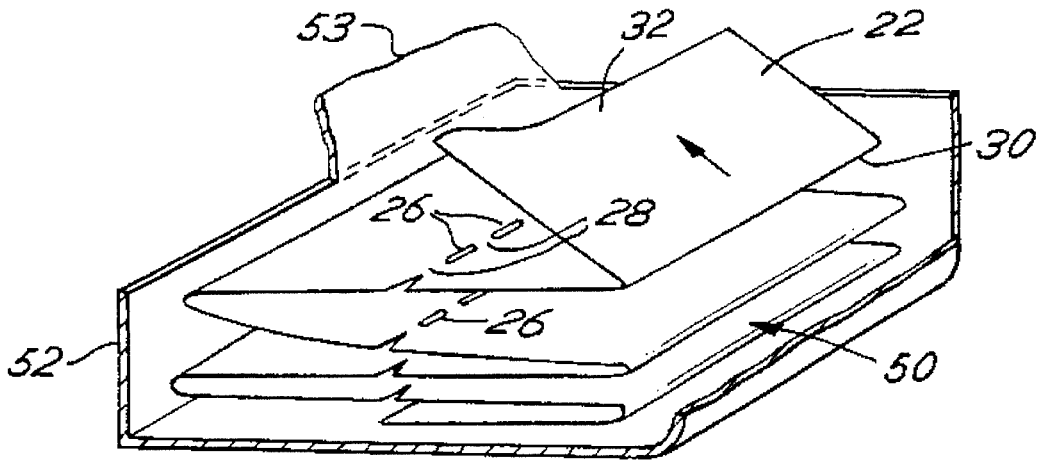
FIG. 17 is a cutaway isometric view of a stack of zig zag folded tissue in a package having a tear away cover.
Figure 18:
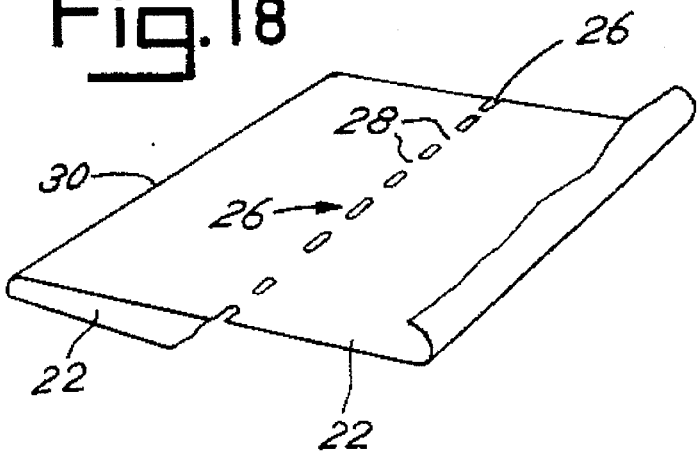
FIG. 18 is a cutaway isometric view of an alternative pattern of tear perforations for a tissue sheet.

The drawings depict various alternative embodiments of the invention. Referring first to FIGS. 1 to 4, there is illustrated a first preferred embodiment. FIGS. 5 to 9 depict a second embodiment. FIGS. 10 to 12 depict a third embodiment. FIGS. 13 to 16 depict a fourth embodiment. Each of the four (4) embodiments receive and dispense moist tissues having a common construction or configuration; the tissues comprise a folded stack 50 of connected tissue sections 22. FIGS. 17 and 18 depict tissue configurations.

Thus, as shown in the figures, a moist tissue sheet 20 is defined as a continuous, elongated sheet 20 having an elongated or longitudinal direction indicated by the arrow in FIG. 17. The sheet 20 is folded into separate connected sections 22 which are separated one from another by a line of perforations 26 through the sheet 20 in a line extending from one side to the other of the sheet 20. The sheet 20 is folded in a zig zag, overlay pattern which defines a single uniform generally rectangular shaped packet or stack 50 of tissue sections 22 with each section 22 being separated one from the other by spaced tear perforations 26.

In practice, the sheet 20 may be many feet long and the zig zag folded sections 22 may be characterized by repeated perforations in the range of every four (4) to twelve (12) inches. The width of the sheet 20 may be in the range of three (3) to twelve (12) inches preferably. The tear perforations 26 in the sheet 20 cut through a majority of the sheet 20, though the pattern and extent depend, in part, upon the material defining the sheet 20. Thus, the sections 22 may be separated from one another by a series of perforations or slits 26 thereby leaving connecting elements 28 connecting the separate sections 22. In a sheet 20 which is seven (7) inches in width, for example, there may be seven (7) such equally spaced, connecting segments or elements 28, each being one thirty second (1/32) of an inch in width. The connecting segments 28 may be equally spaced (as in FIG. 17) or concentrated at the center and edges (as in FIG. 18) of the sheet 20. Equal spacing or center with side edge connections only are preferred.

Figure 3:
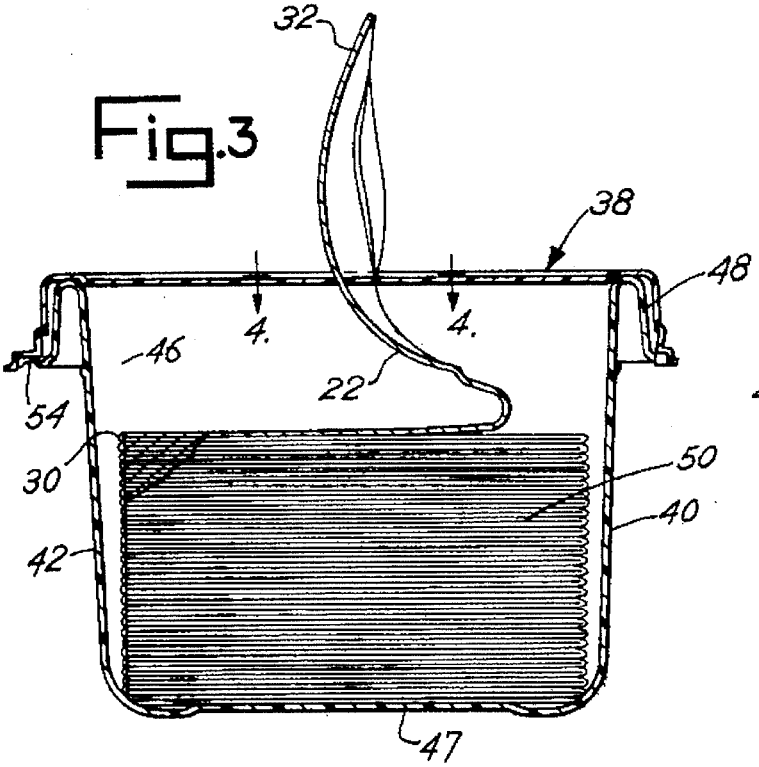
FIG. 3 is a cross sectional view taken along the line 3—3 in FIG. 2.

Described are typical dimensions of sheets and typical perforation 26 and connecting section 28 patterns. The range and configuration of such is quite variable in order to accomplish the objectives of the invention. The invention is directed, principally, to the concept of having a single, elongated sheet folded in a zig zag, overlay pattern with each of the separate connecting sections 22 defined by perforations such as perforations 26. The folded zig zag configuration may result in the perforations 26 being positioned at the midpoint between the front and the back of each stack of tissue (FIG. 17). Alternatively, the tear line 24 or perforations 26 may be positioned at the fold, for example, the fold 30 as shown in FIG. 3. Various other positions and patterns of the line of separation 24 is possible. Again, it is appropriate and desirable to have a continuous, elongated sheet of tissue having a free outer end 32, generally parallel spaced sides with the sheet folded in a zig zag, overlay pattern to define a stack because the folding machinery and process for such folding is typically much less expensive than machinery required for interfolding separate tissues.

The Tissue Dispensing Containers

The tissue dispensing containers of the embodiments of the invention include a lower or tissue containing box 36 and a cooperative top or lid 38. The box 36 and lid 38 are typically molded from plastic material. The box 36 is generally a rectangular parallelpiped. It includes a front 40, a back 42, opposite sides 44 and 46 and a bottom 47. A circumferential top rim 48 defines an opening for receipt of a stack 50 of folded tissue. Typically, the stack 50 of folded tissue may be provided in a liner package 52 in FIGS. 9 and 17 which is designed to slide or slip into the box 36. The liner package 52 (in FIG. 17) may include a removable flexible planar sealing sheet 53 sealed over the top of the package 52 for removal just prior to insertion of the package 52 and the stack 50 into the box 36. Alternatively, the liner package 52 may be omitted and the stack 50 just maintained within the box 36. The stack 50 may also be contained in a flexible film overwrap package (not shown) that could have a resealable opening wherein the entire overwraped package can be inserted inside the box 36. In any event, the sides 44 and 46 of the box 36 are spaced sufficiently for receipt of the stack 50. Similarly, the front 40 and back 42 are appropriately spaced and the box 36 is sufficiently deep enough to fully receive the rectangular, parallelpiped stack 50 with the free end 32 extending toward the lid 38.

The lid or top 38 is generally congruent with and overlies the rim 48. In preferred embodiments, a living hinge 54 in FIG. 6, along one side of the rim 48 and one side of the lid 38 connects the lid 38 with the box 36. This enables the lid 38 to be pivoted out of engagement with the rim 48 to refill the box with a new stack 50 when desired. The rim 48 and lid 38 are constructed so that when they overlie one another, they effect a seal sufficient to prevent the escape of moisture from the moistened stack 50.

Figure 1:
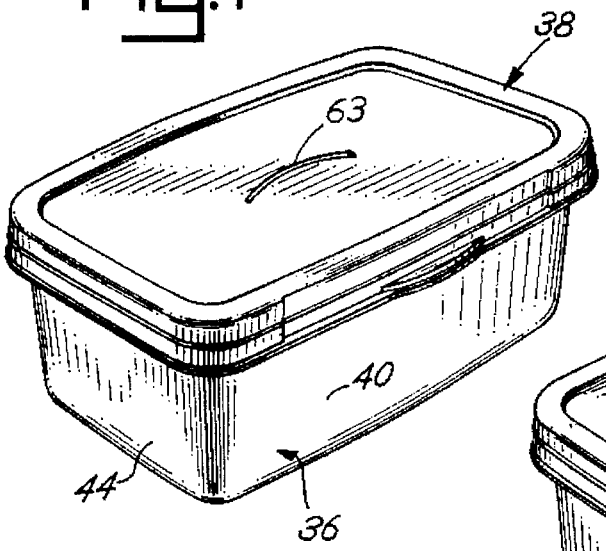
FIG. 1 is an isometric view of a first embodiment of the tissue dispenser or package of the invention.
Figure 2:
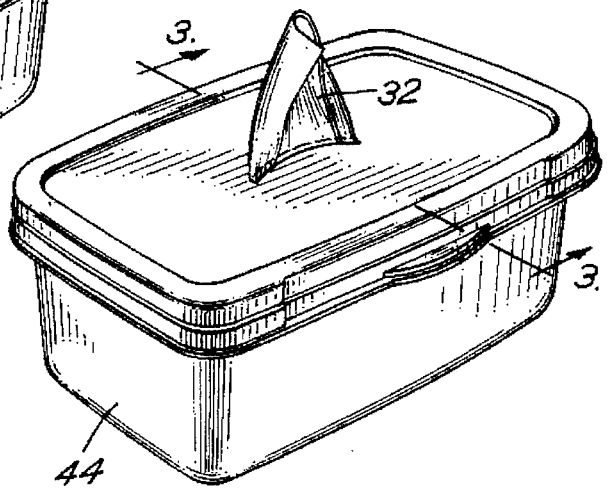
FIG. 2 is an isometric view of the embodiment of FIG. 1 wherein the free end of a stack of tissues has been pulled through a slit in the lid of the dispenser.
Figure 4:
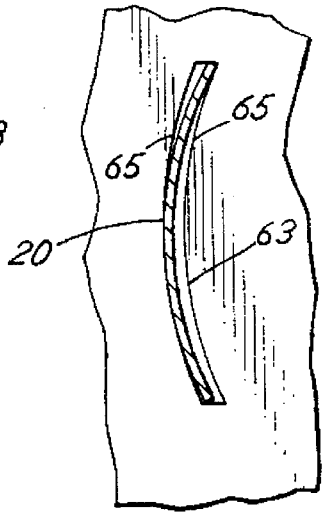
FIG. 4 is a cross sectional view of the tissue sheet and lid slit taken along the line 4—4 in FIG. 3.
Figure 13:
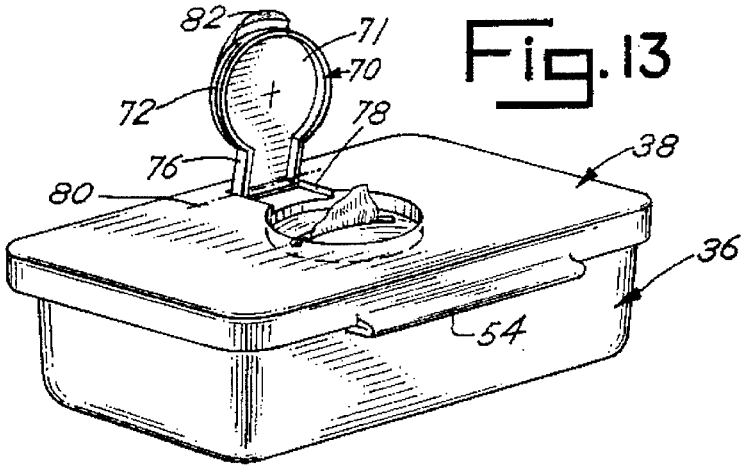
FIG. 13 is an isometric view of another embodiment of he invention.

In the embodiment of FIGS. 1 to 3, the lid 38 includes an arcuate slit 63 which extends generally between the sides 44, 46 and which is positioned midway between the front and back 40, 42 of the box 36, generally over the midpoint of a stack 50 in box 36. The slit 63 has a constant radius and extends between sides 44, 46 a distance of about ten (10) percent to seventy five (75) percent of the width of the stack 50 in box 36 (preferably less than about fifty (50) percent of the width). The slit 63 is uniform in width and is defined by slit sides 65 as shown in FIG. 4 which are spaced a distance greater than the thickness of the free end 32 of the tissue 20. The spacing of slit sides 65 is determined by balancing the following factors:

a) Maintaining moisture within the dispenser. This factor calls for restricting slit dimensions.

b) Free movement of the moist tissue through the slit 63 in response to manual (one hand) pulling. This factor calls for increasing slit dimensions.

c) Frictional restriction of the tissue to enable the tissue sections 22 to be separated by pulling sharply on the free end 32 with one hand to thereby tear the tissue along a line defined by perforations 26 between the sections 22. The frictional restriction also prevents the free end 32 from falling back into the dispenser after a section 22 is removed from sheet 20 so that after tearing a small end of the tissue remains exposed for manual gripping. This factor is dependent at least in part on the material forming the tissue, the pattern and size of the perforations, the moisture content, the moisturizing material, and the thickness of the lid adjacent the slit 63.

Note that the free end 32 projecting through the slit 63, or any slit of the other embodiments, is not the corner of the tissue section 22. Rather, it is the center of an edge of tissue section 22 (though when initially inserting the end 32 through a slit (e.g. slit 63), a corner may be initially directed into the slit. Nonetheless, the side edge of a section 22 will project through or partially through slit 63 or each section 22 is torn from the sheet 20.

The lid 38 in the embodiments of FIG. 5 through 16 includes a central counterbore 60 which is positioned midway between the sides 44 and 46 and midway between the front 40 and back 42. Counterbore 60 could be cylindrical in shape with a matching lower counterbore surface 62. Those of skill in the art will recognize alternative shapes for counterbore 60. Importantly, the counterbore 60 covers the slit 64. In the center of the surface 62 is the slit 64 defined by slit sides 66 and 68. In the embodiment of FIGS. 13 to 16, the slit 64 is arcuate in shape and surface 62 is convex. The slit 64 extends generally transversely between the sides 44 and 46 and covers a distance between the sides 44, 46 of from ten (10) to seventy-five (75) percent of the spacing between the sides 44 and 46. The spacing of the sides 66 and 68 of slit 64 (and all the slits disclosed) is an important feature of the invention inasmuch as the slit 64 is designed to frictionally restrict movement of the tissue, in particular, the free end 32 thereof as discussed previously. Thus, the slit 64 comprises a construction to frictionally engage the tissue sheet 20 with the force required to separate sections 22 and tear the connecting elements 28 which is about the same or slightly more than the force to move the tissue sheet through the slit manually. In this manner, tissue sheet 20 may be :moved through the slit 64, following tearing of connecting sections 28 while the sheet 20 remains with the free end 32 in the slit 64 for further gripping.

The lid 38 of the embodiments of FIG. 5 to 16 also includes a cap 70 cooperative therewith. The cap 70 includes a body section 71 which is generally congruent with the counterbore 60. The body section 71 may include a circumferential rib 72 which coacts with the inside surface 74 of the counterbore 60 to provide substantially moisture proof sealing of the cap 70. This precludes the escape of moisture from the slit 64 and maintains the contents of the container and any protruding free end 32 of the tissue sheet 20 in a moistened condition when the cap 70 is seated in the counterbore 60. The cap 70 also includes an extension or hinge member 76 which is pivotally connected in a recess 80 for pivoting about an axis 78. Thus, the cap 70 may be moved from an open position as shown in FIG. 6, for example, to a closed position such as in FIG. 9, for example. The cap 70 further includes a projecting tab 82 which may be manually engaged to move the cap 70 about its pivot axis 78.

Figure 14:
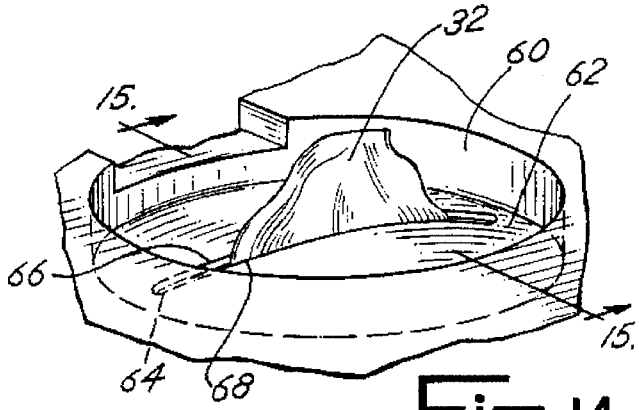
FIG. 14 is an enlarged isometric view of the dispenser slit of the embodiment of FIG. 13.
Figure 15:
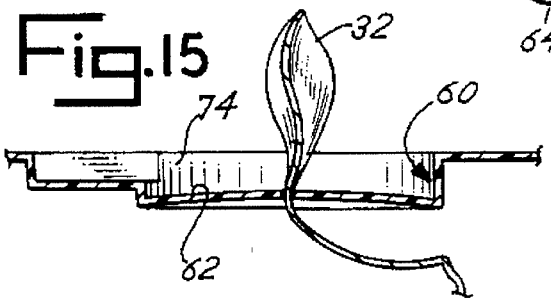
FIG. 15 is a sectional view of the slit of FIG. 14 along the line 15—15.
Figure 16:
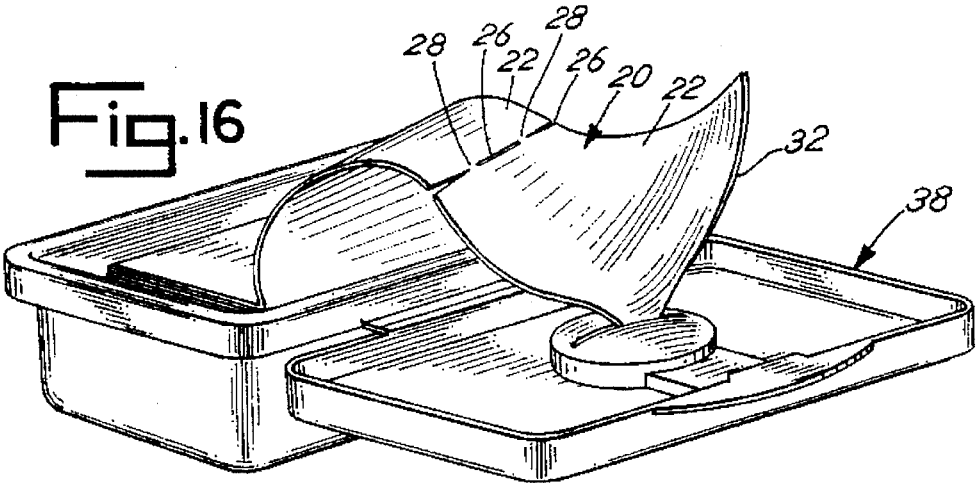
FIG. 16 is an isometric view depicting the embodiment of FIG. 13 with the lid open to reveal the free end of the tissue.

As shown in FIG. 14, the slit 64 is arcuate having a generally constant radius of curvature. Alternative embodiments for the slit 64 are depicted in other figures. For example, in FIG. 11, the slit 94 includes opposite end sections 96 and 98 which have expanded spacing so that when the tissue sheet 20 is withdrawn therethrough, the excess tissue material will fit within the elongated or expanded portions 96 and 98. The shape of the slit may be varied in many respects to accomplish the goals of frictionally preventing the free end 32 of the moistened tissue sheet 20 from moving in the slit except pursuant to manual tension. Thus, the slit 64 may be sinusoidal. It may have a variable curvature. The thickness of the material forming the lid 38 at the slit 64 may also be varied. As shown in FIGS. 5 to 7, the slit 99 may be augmented by having upward tabs or projections 100 on one or both sides of the slit 99. In the embodiment depicted, the slit 99 is a straight slit with the upward projections 100 positioned on opposed or opposite sides thereof. The upward projections 100 each include a center detent 102 which facilitates gripping of the free end 32 of the tissue sheet 20. The upward projections 100 are sized to extend upwardly within the counterbore 60 so that the cap 70 may fit over the projections 100 as shown in FIG. 9. The projections 100 preferably extend outwardly from surface 62 to facilitate feeding the free end 32 through slit 99. The projections 100 may, thus, fit over the slit 99 in part.

A purpose of this invention is, thus, to permit easy grasping of the free edge 32 of the top towel 22, and provide for the ability to withdraw said towel 22 and separate it from the next towel 22 while leaving a small portion of the next towel exposed. This is accomplished by achieving a balance between the strength of the tissue sheet connecting sections 28 (i.e. perforation pattern) and the friction derived from the shape, size and construction of the slit 64.

Various other modifications may be made to the construction. For example, the counterbore may be eliminated and the cap 70 may be positioned over a closed rib or detents on the top of the surface of the lid 38. Thus, while there have been set forth preferred embodiments of the invention, it is to be understand that the invention is only to be limited by the following claims and their equivalents.

What is claimed is:

1. In combination, a moist tissue sheet and an associated dispenser for the moist tissue sheet comprising:

(a) a continuous elongated sheet of tissue having a longitudinal direction, a free outer end, generally parallel spaced sides, said sheet folded in a zig-zag, overlaid pattern to define a stack, said sheet having connected sections defined by spaced, tear perforations extending from side to side, each of said tear perforations having a pattern defined by a series of spaced slits through the tissue; and (b) a tissue dispensing container sufficiently sealed to prevent escape of moisture and having a separable top with a slit therethrough, said top having an outer shape generally congruent with the stack of folded tissue, said slit positioned generally midway between the sides of the sheet in the container, said slit positioned in a counterbore recess defined in the top of the container, said slit extending in the range of about ten (10) to seventy-five (75) percent of the width of the side to side dimension of the stack of folded tissue, said slit having slit sides defining a through passage for the free end of tissue, said sides spaced apart greater than the thickness of the tissue whereby the moist tissue sheet may be pulled through the slit while being frictionally restrained by the slit, sufficiently to permit tearing of the sheet along a line of spaced perforations as the sheet is prevented from freely sliding in the slit in either direction, said tissue being manually moveable through the slit.

2. The combination of claim 1 further including an integral cap in the top, said cap pivotal between the position coacting with the counterbore recess to cover the slit and the free outer end of the tissue and the position to expose the counterbore recess and the free end of the tissue for removal of the tissue through the slit.

3. The combination of claim 1 further including a cap member congruent with the counterbore recess to cover the slit and the free outer end of the tissue and removable to expose the counterbore recess and the free end of the tissue for removal of the tissue through the slit.

4. The combination of claim 1 wherein the counterbore recess is generally circular and the slit is retained within the diameter of the circular recess.

5. The combination of claim 1 further including a cap member having a hinge edge, said cap integrally molded with the top and pivotally connected thereto along the edge, said cap having a portion congruent with the counterbore recess whereby the congruent portion may be fitted into the counterbore recess to cover the slit and free outer end of the tissue.

6. The combination of claim 1 wherein the slit has a generally uniform width along its length.

7. The combination of claim 1 wherein the slit has opposite ends and a connecting section between the opposite ends, said ends having a width greater than the width of the connecting section whereby the ends permit passage of more tissue than the connecting section.

8. The combination of claim 1 wherein the slit is curved and has a generally constant radius of curvature.

9. The combination of claim 1 wherein the slit is curved and has connected sections of variable radius of curvature.

10. The combination of claim 1 wherein the slit has a sinusoidal configuration.

11. The combination of claim 1 wherein the slit is curved.

12. The combination of claim 1 wherein the slit includes a lip member along at least a portion of at least one edge whereby the tissue frictionally engages the lip to assist in control of the force required for pulling the tissue through the slit and also prevents unassisted movement of the tissue through the slit.

13. The combination of claim 1 wherein the slit includes opposed upwardly extending lip members on opposite sides of he slit whereby the tissue frictionally engages the lips to assist in control of the force required for pulling the tissue through the slit and also prevents unassisted movement of the tissue through the slit.

14. The combination of claim 1 wherein the slit extends in the range of less than fifty (50) percent of the width of the side to side dimension of the stack of folded tissue.

15. The combination of claim 1 wherein the slit is straight.

16. The combination of claim 1 including a cap member hinged to the top, said cap member having a portion congruent with the counterbore recess whereby the congruent portion may be fitted into the counterbore recess to cover the slit and free outer end of the tissue.

17. The combination of claim 16 wherein the cap member includes means for retaining the cap member in the counterbore recess.

18. The combination of claim 17 wherein the means for retaining include frictional engaging members on the cap and counterbore recess.

19. The combination of claim 1 wherein the top is generally rectangular and the container also includes a tissue holding box on which the top is fitted.

20. The combination of claim 19 wherein the top and the box are connected by an integrally molded, living hinge along a side of the box.

21. The combination of claim 1 including a supplemental friction element adjacent at least one side of the slit for engaging tissue upon withdrawal thereof from the slit.

22. The combination of claim 12 wherein the lip member comprises a planar extension from the counterbore, said planar extension extending outwardly from the top.

23. The combination of claim 22 wherein the planar extension extends a uniform distance from the counterbore recess.

24. The combination of claim 23 wherein the planar extension includes a detent to facilitate manual gripping of the tissue.

25. The combination of claim 1 wherein the slit comprises means for frictionally engaging the tissue sheet wherein the force to separate the connected sections is approximately the same or slightly more than the force to move the tissue sheet through the slit whereby a section of the tissue sheet may be separated upon withdrawal of the sheet through the slit while maintaining a portion of the next section through the slit for manual gripping.

26. A moist tissue dispensing container, comprising:

a container top;

a separate container box adapted to receive the top so as to be sufficiently sealed therewith to prevent escape of moisture from the container;

said container and top having a generally rectangular shape with opposite sides, a front and a back connecting the sides;

said top having a slit extending partially between the sides, said slit extending in the range of ten (10) to seventy-five (75) percent of the width of the top between the sides, said slit having sides defining a through passage for the free end of a tissue, said sides spaced apart greater than the thickness of a tissue whereby a moist tissue sheet in the box extending through the slit may be pulled through the slit while being frictionally restrained by the slit sufficiently to permit tearing of the sheet along the line of spaced perforations in the sheet as the sheet is prevented from freely sliding in the slit in either direction.

27. The combination of claim 26 further including an integral cap in the top pivotal between the position coacting with a counterbore recess to cover the slit and the free outer end of the tissue and to expose the counterbore recess and the free end of the tissue for removal of the tissue through the slit.

28. The combination of claim 26 further including a cap member congruent with a counterbore recess to cover the slit and the free outer end of the tissue and to expose the counterbore recess and the free end of the tissue for removal of the tissue through the slit.

29. The combination of claim 26 wherein a counterbore recess is generally circular and the slit is retained within the diameter of the circular recess.

30. The combination of claim 26 further including a cap member having a hinge edge, said cap integrally molded with the top and pivotally connected thereto along the edge, said cap having a portion congruent with a counterbore recess whereby the congruent portion may be fitted into the counterbore recess to cover the slit and free outer end of the tissue.

31. The combination of claim 26 wherein the slit has a generally uniform width along its length.

32. The combination of claim 26 wherein the slit has opposite ends and a connecting section between the opposite ends, said ends having a width greater than the width of the connecting section whereby the ends permit passage of more tissue than the connecting section.

33. The combination of claim 26 wherein the slit is curved and has a generally constant radius of curvature.

34. The combination of claim 26 wherein the slit is curved and has connected sections of variable radius of curvature.

35. The combination of claim 26 wherein the slit has a sinusoidal configuration.

36. The combination of claim 26 wherein the slit is curved.

37. The combination of claim 26 wherein the slit includes a lip member along at least a portion of at least one edge whereby the tissue frictionally engages the lip to assist in control of the force required for pulling the tissue through the slit and also prevents unassisted movement of the tissue through the slit.

38. The combination of claim 26 wherein the slit includes opposed upwardly extending lip members on opposite sides of he slit whereby the tissue frictionally engages the lips to assist in control of the force required for pulling the tissue through the slit and also prevents unassisted movement of the tissue through the slit.

39. The combination of claim 26 wherein the slit extends in the range of less than about fifty (50) percent of the width of the side to side dimension of the stack of folded tissue.

40. The combination of claim 26 wherein the slit is straight.

41. The combination of claim 26 including a cap member hinged to the top, said cap member having a portion congruent with the counterbore recess whereby the congruent portion may be fitted into the counterbore recess to cover the slit and free outer end of the tissue.

42. The combination of claim 41 wherein the cap member includes means for retaining the cap member in the counterbore recess.

43. The combination of claim 42 wherein the means for retaining include frictional engaging members on the cap and counterbore recess.

44. The combination of claim 26 wherein the top and the box are connected by an integrally molded, lining hinge along a side of the box.

45. The combination of claim 26 including a supplemental friction element adjacent at least one side of the slit for engaging tissue upon withdrawal thereof from the slit.

46. The combination of claim 37 wherein the lip member comprises a planar extension from the counterbore, said planar extension extending outwardly from the top.

47. The combination of claim 46 wherein the planar extension extends a uniform distance from the counterbore recess.

48. The combination of claim 47 wherein the planar extension includes a detent to facilitate manual gripping of the tissue.

49. A moist tissue dispensing container, comprising:

a container box including opposite sides, a front, a back and bottom to define an enclosure with an open top; a lid having sides, a front, a back and a top surface affixed to the open top of the box;

means for sealing the lid to the box sufficiently to prevent escape of moisture from the container; and said container having a slit extending partially between the sides, said slit extending in the range of ten (10) to seventy-five (75) percent of the width of the top between the sides of the top, said slit having slit sides to define a through passage in the top existing in the top surface for the free end of a tissue, said slit sides spaced apart a distance greater than the thickness of a tissue whereby a moist tissue sheet in the box extending through the slit may be pulled through the slit while being frictionally restrained by the slit sufficiently to permit tearing of the sheet along a line of spaced perforations in the sheet as the sheet is prevented from freely sliding in the slit in either direction.

50. A moist tissue dispensing container, comprising:

a container box including opposite sides, a front, a back and bottom to define an enclosure with an open top; a lid having sides, a front, a back and a top surface affixed to the open top of the box;

means for sealing the lid to the box sufficiently to prevent escape of moisture from the container;

said container having a slit extending partially between the sides, said slit extending in the range of ten (10) to seventy-five (75) percent of the width of the top between the sides of the top, said slit having slit sides to define a through passage in the top existing in the top surface for the free end of a tissue, said slit sides spaced apart a distance greater than the thickness of a tissue whereby a moist tissue sheet in the box extending through the slit may be pulled through the slit while being frictionally restrained by the slit sufficiently to permit tearing of the sheet along a line of spaced perforations in the sheet as the sheet is prevented from freely sliding in the slit in either direction, said lid including a sealing element around the slit; and further including a cap for the slit attached to the lid and movable between an open position exposing the slit and a closed position covering the slit, said cap extending over the entire slit in the closed position and including a sealing element cooperative with the sealing element of said lid to thereby sufficiently seal the cap to the lid to prevent escape of moisture from the container box.

* * * * *